US009989246B2

(12) United States Patent
Toqan et al.

(10) Patent No.: US 9,989,246 B2
(45) Date of Patent: Jun. 5, 2018

(54) FURNACES AND METHODS OF REDUCING HEAT DEGRADING OF METAL HEATING COILS OF FURNACES

(71) Applicant: ATD COMBUSTORS, LLC, Abu Dhabi (AE)

(72) Inventors: Majed Toqan, Abu Dhabi (AE); Prabhat Naredi, Abu Dhabi (AE); Naji Amira, Abu Dhabi (AE); Stefan Tschirren, Baden (CH); Jörg Pross, Baden (CH)

( * ) Notice: Subject to any disclaimer, the term of this patent is extended or adjusted under 35 U.S.C. 154(b) by 154 days.

(21) Appl. No.: 14/857,499

(22) Filed: Sep. 17, 2015

(65) Prior Publication Data

US 2016/0076761 A1 Mar. 17, 2016

Related U.S. Application Data

(60) Provisional application No. 62/051,822, filed on Sep. 17, 2014, provisional application No. 62/165,718, filed on May 22, 2015.

(51) Int. Cl.
*F23C 9/08* (2006.01)
*F23L 7/00* (2006.01)

(52) U.S. Cl.
CPC ..... *F23C 9/08* (2013.01); *F23L 7/00* (2013.01); *F23C 2202/20* (2013.01); *F23L 2900/07002* (2013.01); *F23L 2900/07003* (2013.01)

(58) Field of Classification Search
CPC ..... F23C 9/08; F23C 2202/20; F23K 7/00
USPC ..... 431/4, 9, 160, 115–116
See application file for complete search history.

(56) References Cited

U.S. PATENT DOCUMENTS

| | | | | | |
|---|---|---|---|---|---|
| 2,174,663 | A * | 10/1939 | Keller | F28D 7/08 | 122/182.2 |
| 2,601,667 | A * | 6/1952 | Permann | C10G 9/20 | 110/205 |
| 3,204,611 | A * | 9/1965 | Stone | C10G 9/20 | 110/317 |
| 4,412,975 | A * | 11/1983 | Parizot | B01J 8/062 | 122/235.14 |
| 4,467,731 | A * | 8/1984 | Di Fonzo | F23G 5/44 | 110/235 |
| 5,092,761 | A * | 3/1992 | Dinicolantonio | F23C 9/00 | 110/265 |
| 7,819,656 | B2 * | 10/2010 | Ponzi | C10G 9/206 | 110/261 |
| 8,007,681 | B2 * | 8/2011 | Farmayan | C01B 13/02 | 252/186.1 |
| 2012/0052450 | A1 * | 3/2012 | Lou | F23L 7/007 | 431/2 |
| 2014/0212823 | A1 * | 7/2014 | Novak | F23M 5/00 | 431/11 |

* cited by examiner

*Primary Examiner* — Gregory Huson
*Assistant Examiner* — Nikhil Mashruwala
(74) *Attorney, Agent, or Firm* — William Gray Mitchell

(57) ABSTRACT

A method includes providing a furnace including a radiant heating zone having metal heating coils and burners, concurrently applying a combustion media, having a combustibility, and a diluent to the burners, the burners burning the combustion media producing flames heating the radiant heating zone, and the diluent reducing the combustibility of the combustion media for reducing heat generated by the flames for reducing heat degradation of the metal heating coils.

9 Claims, 4 Drawing Sheets

FURNACES AND METHODS OF REDUCING HEAT DEGRADING OF METAL HEATING COILS OF FURNACES

CROSS-REFERENCE TO RELATED APPLICATIONS

This application claims the benefit of U.S. Provisional Patent Application Ser. No. 62/051,822, filed Sep. 17, 2014, and U.S. Provisional Patent Application Ser. No. 62/165,718, filed May 22, 2015, the entire contents of which are incorporated herein by reference.

FIELD OF THE INVENTION

The present invention relates to furnaces.

BACKGROUND OF THE INVENTION

Water evaporation, process gas heating, steam cracking, and pyrolysis of hydrocarbons are examples of processes often carried out in tubular coils, the process coils, inside furnaces. These processes are often considered heart of the industrial plant and have significant influence on the economics of the overall industrial plant. The duration that heater or tubular coils can operate without failure depends on two primary factors: fouling and crack initiation. Fouling and cracking are forms of coil degradation. Fouling occurs when deposits, such as coke and scale, build up on the inside surfaces of heating coil. These deposits in process fluid stream act as a resistance to heat flux and the outside metal temperature of the tube increases in response to allow for the equivalent flux through a higher resistance. The second factor is crack initiation, which depends strongly upon the makeup of the radiant heating coil, thermal stresses, and fatigues. Typically, the coil is made up of metal or metal alloy and has a nominal operating temperature range of from 400 K to 1400 K. Metals and metal alloys are sensitive to extreme temperatures. The coil will begin to deteriorate and become damaged or at least prone to damage when the coil is exposed to a temperature that exceeds the upper end of its nominal operating temperature range. As a result, a typical heater must be monitored carefully at substantial cost to maintain specific temperature ranges. This becomes problematic as deposits build up on the coil because more heat must be added to maintain the efficiency of the system.

For example, in a typical process gas heater used in the refineries or steel industries, the reformed gas, e.g. CO, $H_2$, $CO_2$, etc., mixture is preheated to a temperature of from about 400° C. to 600° C. This preheat occurs in the convection section of the heater. The mix then passes to the radiant section where a constant outlet temperature on the order of about 700° C. to 950° C. is maintained. The flue gas temperature exiting the radiant section of the fired heater is typically above 1,000° C. The heat transfer to the coils is primarily by radiation. In some conventional designs, such as boilers in power plants, approximately from 30% to 40% of the heat fired as fuel into the furnace is transferred into the coils in the radiant section. The balance of the heat is recovered in the convection section either as feed preheat or to superheat steam. Given the limitation of small tube volume to achieve short residence times and the high temperatures of the process, heat transfer into the reaction tube is difficult. As a result, high heat fluxes are used and the operating tube metal temperatures are close to the mechanical limits for even exotic metallurgies.

In most cases, tube metal temperatures limit the extent to which residence time can be reduced. A combination of higher process temperatures required at the coil outlet and the reduced tube length, i.e. the reduced tube surface area, results in higher flux and higher tube metal temperatures. Tube metal temperatures are also a limiting factor in determining the capacity of these radiant coils since more flux is required for a given tube when operated at higher capacity. The exotic metal reaction tubes located in the radiant section of the cracking heater represent a substantial portion of the cost of the heater. Therefore, it is important that they are operated at as high and as uniform a heat flux as possible consistent with the design objectives of the heater. This will minimize the number and length of the tubes and the resulting total metal surface area required for a given design capacity. Furthermore, having uniform heat flux across tube bundles will cause uniform thermal elongation of coils resulting in greater life of spring hangers on which coils are suspended and thus minimizes maintenance requirement.

In a typical furnace, the heat is supplied by burners, which can be mounted at the furnace floor, the furnace roof, the furnace sidewalls, or some combination thereof. The coils are typically suspended from the top of the radiant section and hang between the radiant walls. A small portion of the heat transferred is done convectively by the flue gases within the firebox transferring the heat directly to the coils. However in a typical furnace, greater than 85% of the heat is transferred by radiation.

In any flame from a burner, the flame has an inherent characteristic combustion profile, inherently generates heat, and inherently generates soot. As the fuel and air mixture leaves the burner, combustion begins. As the combustion reaction continues, the temperature of the combustion mixture increases and heat is released. At some distance from the burner, there is a point of inherent maximum combustion by the flame and hence an inherent maximum or peak heat release. During this process, heat is absorbed by the process coils. The characteristics of the flame, and its inherent maximum or peak heat, depend upon the total firing from that burner and the specifics of the burner design. Different flame shapes and heat release profiles are possible, depending upon how the fuel and air are mixed. Because of the characteristic heat release profile from these burners, an uneven heat flux profile, i.e. heat absorbed profile, is sometimes created. The typical flux profile for the radiant coil shows a peak flux near the center elevation of the firebox, i.e. at the point of maximum combustion or heat release for the hearth burners, with the top and bottom portions of the coil receiving less flux. In some heaters, radiant wall burners are installed in the top part of the sidewalls to equalize the heat flux profile in the top portion of the coil.

There have been a number of attempts to control the flux profile within a heater. It is known that staging the fuel to burners can be used to adjust the flame shape and thus impact the point of maximum heat release. Sometimes burners are designed with several differing fuel injection points. In some methods, side burners are used in combination with floor burners in a box chamber where combustion gases pass upwardly through the radiant chamber to a convention section. Methods of producing internal recirculation of combustion gases into the burner for producing a favorable influence on homogenizing combustible mixtures at the burners for reducing flame temperature and NOx emission have also been proposed. Still other methods have been proposed that depend on injection of steam in the furnace to reduce peak temperature and NOx emission. The results of these and other efforts, however, have not been entirely satisfactory, thereby necessitating further improvement in the art.

SUMMARY OF THE INVENTION

According to the principle of the invention, a method includes providing a furnace, the furnace includes a radiant heating zone having metal heating coils and burners, concurrently applying a combustion media, having a combustibility, and a diluent to the burners, the burners burning the combustion media producing flames heating the radiant heating zone, and the diluent reducing the combustibility of the combustion media for reducing peak heat generated by the flames for reducing heat degradation, such as fouling and cracking, of the metal heating coils. The combustion media includes fuel. In another embodiment, the combustion media includes fuel and air. The diluent is selected from a group consisting of flue gas, steam, hydrogen, carbon dioxide, and nitrogen. Flue gas and steam diluents each produce reduced soot formation by the flames, in accordance with the principle of the invention. Radiation flux directly correlates to flame emissivity. Accordingly, soot formation by the flames is reduced, which reduces flame emissivity of the flames, the ability of the flames to emit radiant energy, which, in turn, reduces local radiation flux, all of which contributes to reducing the temperature of the metal heating coils and reducing heat degradation of the metal heating coils, when the diluent is flue gas in one embodiment, and when the diluent is steam in another embodiment.

According to the principle of the invention, a method includes providing a furnace, the furnace includes a radiant heating zone having metal heating coils and burners, applying combustion media to the burners, the combustion media has a combustibility and includes, air, fuel, and a diluent in at least one of the air and the fuel, the burners burning the combustion media producing flames heating the radiant heating zone, and the diluent reducing the combustibility of the combustion media for reducing the peak heat generated by the flames for reducing heat degradation, such as fouling and cracking, of the metal heating coils. The combustion media includes fuel. In another embodiment, the combustion media includes fuel and air. The diluent is selected from a group consisting of flue gas, steam, hydrogen, carbon dioxide, and nitrogen. Flue gas and steam diluents each produce reduced soot formation by the flames, in accordance with the principle of the invention. Again, radiation flux directly correlates to flame emissivity. Accordingly, soot formation by the flames is reduced, which reduces flame emissivity of the flames, the ability of the flames to emit radiant energy, which, in turn, reduces local radiation flux, all of which contributes to reducing the temperature of the metal heating coils and reducing heat degradation of the metal heating coils, when the diluent is flue gas in one embodiment, and when the diluent is steam in another embodiment.

According to the principle of the invention, a method includes providing a furnace, the furnace includes a radiant heating zone having metal heating coils and burners, applying a combustion media to the burners, the combustion media having a combustibility, the burners burning the combustion media producing flames heating the radiant heating zone, applying a diluent to the radiant heating zone, and the diluent reducing the combustibility of the combustion media for reducing peak heat generated by the flames for reducing heat degradation, such as fouling and cracking, of the metal heating coils. The combustion media includes fuel. In another embodiment, the combustion media includes fuel and air. The diluent is selected from a group consisting of flue gas, steam, hydrogen, carbon dioxide, and nitrogen. Flue gas and steam diluents each produce reduced soot formation by the flames, in accordance with the principle of the invention. Again, radiation flux directly correlates to flame emissivity. Accordingly, soot formation by the flames is reduced, which reduces flame emissivity of the flames, the ability of the flames to emit radiant energy, which, in turn, reduces local radiation flux, all of which contributes to reducing the temperature of the metal heating coils and reducing heat degradation of the metal heating coils, when the diluent is flue gas in one embodiment, and when the diluent is steam in another embodiment.

BRIEF DESCRIPTION OF THE DRAWINGS

Referring to the drawings.

DETAILED DESCRIPTION

Figure 1:
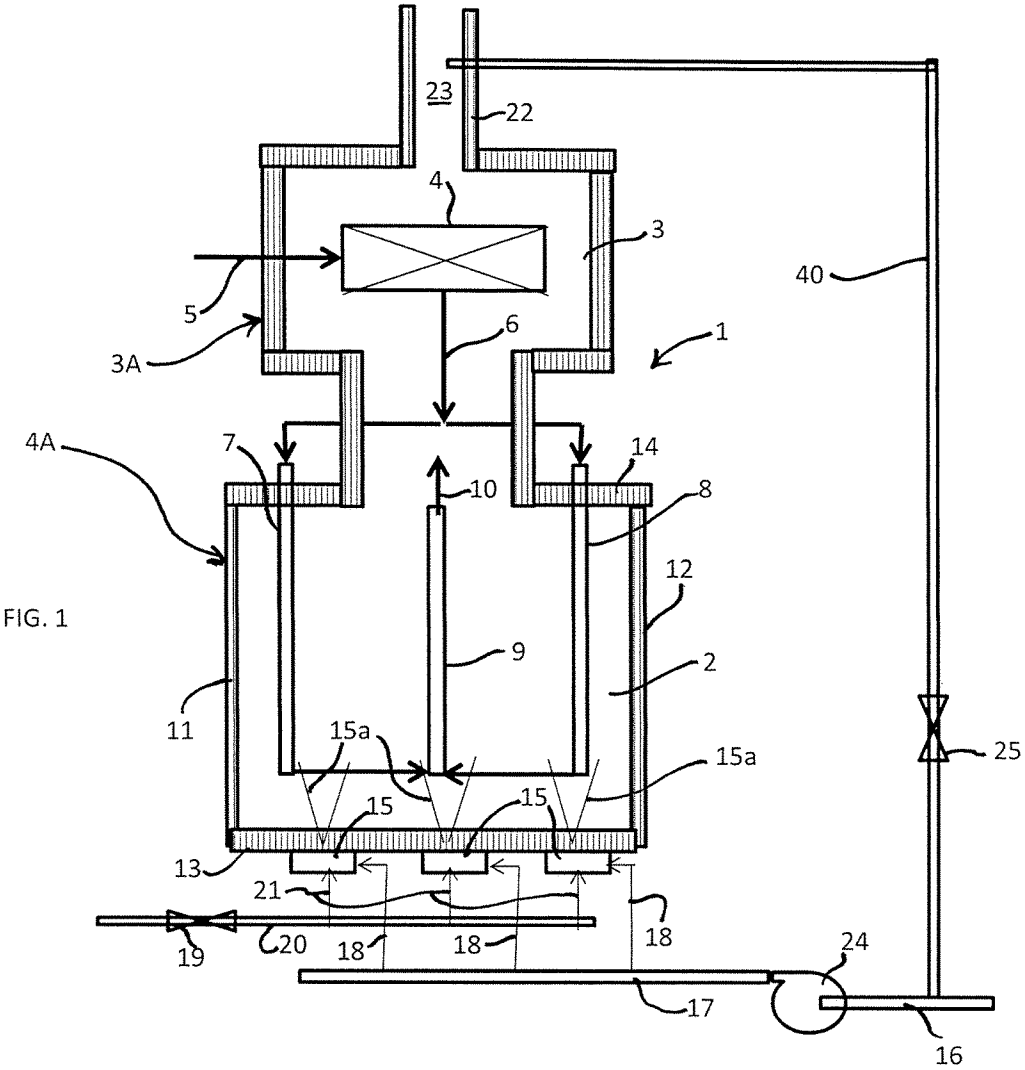
FIGS. 1-4 are highly generalized schematic views of different configurations of furnaces constructed and arranged in accordance with the principle of the invention.

Furnaces and methods of reducing heat degrading of metal heating coils of furnaces are disclosed.

In general, an exemplary method includes providing a furnace, the furnace includes a radiant heating zone having metal heating coils and burners, concurrently applying a combustion media, having a combustibility, and a diluent to the burners, the burners burning the combustion media producing flames heating the radiant heating zone, and the diluent reducing the combustibility of the combustion media for reducing heat generated by the flames for reducing heat degradation, such as fouling and cracking, of the metal heating coils. The combustion media includes fuel. In another embodiment, the combustion media includes fuel and air. The diluent is selected from a group consisting of flue gas, steam, hydrogen, carbon dioxide, and nitrogen. Flue gas and steam diluents each produce reduced soot formation by the flames, in accordance with the principle of the invention. Radiation flux directly correlates to flame emissivity. Accordingly, soot formation by the flames is reduced, which reduces flame emissivity of the flames, the ability of the flames to emit radiant energy, which, in turn, reduces local radiation flux, all of which contributes to reducing the temperature of the metal heating coils and reducing heat degradation, such as fouling and cracking, of the metal heating coils, when the diluent is flue gas in one embodiment, and when the diluent is steam in another embodiment.

Another method embodiment of the invention includes providing a furnace, the furnace includes a radiant heating zone having metal heating coils and burners, applying combustion media to the burners, the combustion media has a combustibility and includes, air, fuel, and a diluent in at least one of the air and the fuel, the burners burning the combustion media producing flames heating the radiant heating zone, and the diluent reducing the combustibility of the combustion media for reducing the heat generated by the flames for reducing heat degradation, such as fouling and cracking, of the metal heating coils. The combustion media includes fuel. In another embodiment, the combustion media includes fuel and air. The diluent is selected from a group consisting of flue gas, steam, hydrogen, carbon dioxide, and nitrogen. Flue gas and steam diluents each produce reduced soot formation by the flames, in accordance with the principle of the invention. Again, radiation flux directly correlates to flame emissivity. Accordingly, soot formation by the flames is reduced, which reduces flame emissivity of the flames, the ability of the flames to emit radiant energy, which, in turn, reduces local radiation flux, all of which contributes to reducing the temperature of the metal heating coils and reducing heat degradation, such as fouling and cracking, of the metal heating coils, when the diluent is flue gas in one embodiment, and when the diluent is steam in another embodiment.

Yet another method embodiment of the invention includes providing a furnace, the furnace includes a radiant heating zone having metal heating coils and burners, applying a combustion media to the burners, the combustion media having a combustibility, the burners burning the combustion media producing flames heating the radiant heating zone, applying a diluent to the radiant heating zone, and the diluent reducing the combustibility of the combustion media for reducing heat generated by the flames for reducing heat degradation, such as fouling and cracking, of the metal heating coils. The combustion media includes fuel. In another embodiment, the combustion media includes fuel and air. The diluent is selected from a group consisting of flue gas, steam, hydrogen, carbon dioxide, and nitrogen. Flue gas and steam diluents each produce reduced soot formation by the flames, in accordance with the principle of the invention. Again, radiation flux directly correlates to flame emissivity. Accordingly, soot formation by the flames is reduced, which reduces flame emissivity of the flames, the ability of the flames to emit radiant energy, which, in turn, reduces local radiation flux, all of which contributes to reducing the temperature of the metal heating coils and reducing heat degradation, such as fouling and cracking, of the metal heating coils, when the diluent is flue gas in one embodiment, and when the diluent is steam in another embodiment.

According to the principle of the invention, a furnace or heater has a radiant section or zone and a convection heating section or zone where the radiant section consists of a furnace floor and side walls including multiple burners and multiple heating coils of metal, wherein the term "metal" means a metal or a metal alloy. An illustrative embodiment of operating such a furnace includes introducing a diluent, such as a product of combustion from a flue gas stack of a furnace in an illustrative example, into an air stream and or a gas stream that is fed to a burner section of the furnace for combustion. The product of combustion is applied to the air via a prevailing difference in static pressure at a flue gas stack of the furnace and a suction line of a combustion fan that delivers air to the burners. In this embodiment, a flue gas recirculation (FGR) ratio in the range of 5-15% is achieved, wherein the FGR ratio is defined as:

$$\text{FGR ratio } (\%)=100[G/(F+A)]$$

Where G=Flue gas flow drawn into air (lb/hr);

A=Air drawn into burner (lb/hr); and

F=Fuel flow drawn into burner (lb/hr).

In other embodiments, the ability to generate a high flue gas ratio can be achieved by using at least one flue gas fan. In other embodiments, $CO_2$ generated by other processes in the industrial plant have sufficient static pressure. Therefore, another aspect of the invention includes diverting a diluent, such as a stream of $CO_2$, generated by the plant processes in an example, to mix with air prior to feeding into the radiant heating zone of the furnace. Still other embodiments of the invention include diverting diluent process steam, diluent hydrogen, diluent carbon dioxide, diluent nitrogen, a combination of two or more of the foregoing diluents or other diluent or combination of diluents, such as from a combustion process, to be mixed with fuel prior to feeding into the radiant heating zone of the furnace, or to be injected directly into the radiant zone of the furnace as a separate stream.

The firebox temperature profile, i.e. the temperature of the radiant heating zone of the firebox, and reduction in peak metal skin temperatures is improved by injection of the diluent in the combustion media (air and/or fuel stream) without having to raise the fuel firing rate. In other words, injecting the chosen diluent, which can be one diluent or a combination of diluents, in the combustion media, the air and/or the fuel feed to the burners at the radiant heating zone of the furnace without raising the fuel firing rate has a favorable influence on the firebox temperature profile, i.e. the temperature of the radiant heating zone, and the reduction in peak metal skin temperatures. Injection of the diluent not only lowers the burner flame temperature of the burners but also raises the temperature at the end portion of firebox thereby leveling out the temperature profile across the longitudinal dimension of the firebox and distribution of the more heat into downstream sections such as convection box or air preheater. Flue gas and steam diluents each produce reduced soot formation by the flames of the burners, in accordance with the principle of the invention. Accordingly, soot formation by the flames is reduced, which reduces flame emissivity of the flames, the ability of the flames to emit radiant energy, which, in turn, reduces local radiation flux, all of which contributes to reducing the temperature of the metal heating coils and reducing heat degradation, such as fouling and cracking, of the metal heating coils, when the diluent is flue gas in one embodiment, and when the diluent is steam in another embodiment, such as fouling and cracking, The invention relates to improvements in furnaces and furnace operations with an objective of improving the operational life of metal heating coils, namely, reducing heat degradation, such as fouling and cracking, of the metal tubes, and reducing burner combustion for providing a uniform heat flux across the metal heating coils. In one aspect, the invention relates to the use of a flue gas as the diluent that is recirculated with combustion air for producing homogeneous temperature profiles in the furnace and across the metal heating coils. The flue gas is mixed with air upstream or downstream of a fan used to deliver combustion air to the burners at the radiant heating zone of the furnace. In other aspects, a stream of flue gas or other gas or diluent, such $CO_2$ or steam generated by other processes in the industrial plant, are mixed with the combustion media to the burners, i.e. the fuel, the air, or both the fuel and the air, for reducing combustion of the flammable gas by the burners for reducing heat degradation of the metal heating coils by favorably influencing heat flux across the heating coils in the radiant heating zone. Other benefits of the invention are reduction in $NO_x$ emissions, reduction in soot formation by the flames when the diluent is flue gas or steam, improved heat distribution across radiant and convection zones for providing improving efficiency, and uniform thermal elongation of metal tubes. In other words, other benefits of the invention include favorably influencing reduction in $NO_x$ emissions, reduction in soot formation by the flames, heat distribution across radiant and convection zones for favorably influencing efficiency, and uniform thermal elongation of metal tubes. The invention has application in heaters for steam generation, and fired heaters in chemical and metal manufacturing industries as well as petroleum refining such as high-temperature cracking of hydrocarbon gases, thermal polymerization of light hydrocarbons, or hydrogenation of oils.

The present invention is described in terms of a burner for use in connection with a furnace, which can be an industrial furnace. It will readily occur to those skilled in the art that the teachings of the present invention also have applicability to other process components, such as boilers in a particular example. Thus, the term "furnace" used herein shall be understood to mean a furnace, a boiler, and other applicable process heaters.

FIG. 1 is a highly generalized section view of a fired heater or furnace 1. In the illustrated embodiment, heater or furnace 1 has a radiant heating section or zone 2 in a firebox 2A and a convection heating section or zone 3 in a convection box 3A. In convection heating zone 3 are heat exchange surfaces 4 for preheating process gas feed 5 entering convection heating zone 3. In a particular embodiment, heat exchange surfaces 4 produce superheated steam. The preheated feed 5 from the convection heating zone 3 is fed at 6 to metal heating coils 7 and 8 suspended vertically in radiant heating zone 2. Cracked or heated product from metal heating coils 7 and 8 exits to feed metal heating coil 9 in radiant heating zone 2, producing heated process output stream 10 that is fed to other equipment. Coils 7, 8, and 9, coiled tubes of metal, whether a metal or a metal alloy, are conventional and can be provided in any desired configuration including vertical and horizontal coils or grouped as one set of coils in other embodiments. Radiant heating zone 2 includes opposite walls 11 and 12 that extend vertically between a floor 13, formed with burners 15, and a roof 14. Burners 15 are directed into radiant heating zone from floor 13, and are mounted to floor 13 in this example. Burners 15 can be mounted at other locations of radiant heating zone 2, including walls 11 and 12, roof 14, or any combination of walls 11 and 12, floor 13, and roof 14. Combustion media, which has an inherent combustibility and which in this embodiment is composed of air 18 supplied from air header 17 and fuel 21, such as fuel oil or gas, supplied from fuel header 20, is fed via headers 17 and 20 to burners 15, which ignite and burn the combustion media to produce flames 15*a*. Flames 15*a* inherently generate heat and soot. Flames 15*a* each also have a point of inherent maximum combustion and an inherent maximum or peak heat. Flames 15*a* heat radiant heating zone 2 of firebox 2A. Control valve 19 in header 20 regulates the amount of fuel flowing into air header 20. Air 18 is delivered into air header 17 by a forced draft fan 24 from air header 16, which is under suction or negative pressure when fan 24 operates.

Operation of furnace 1 generates flue gas 23, a product of combustion of the combustion media by burners 15, which is ejected through stack 22 at the top of convection box 3A. Flue gas 23 is exhausted through stack 22 either by an induced draft fan or with no further assistance when heater 1 is operated at a positive pressure, such as from 5 mbar to 100 mbar in an illustrative embodiment. In a preferred embodiment, conduit 40 couples stack 22 to air header 16 in gaseous communication. Flue gas 23 is a diluent. Part of flue gas 23 is harvested from stack 22 via conduit 40, which transfers the harvested flue gas 23 from stack 22 to air header 16 where it is mixed with air 18 at header 16. Control valve 25 incorporated in conduit 40 is used to control and set the amount of flue gas 23 applied to air 18 in header 16 from stack 22.

Fuel 21 is fed to each burner 15 via fuel header 20. Again, the combustion media applied to burners 15 is a mixture of fuel 21 fed to burners 15 via fuel header 20, and air 18 mixed with flue gas 23 applied to the burners 15 from header 17 that is delivered to header 17 from header 16 in this example. And so the air 18 component of the combustion media, which incorporates the diluent flue gas 23, is continuously applied to burners 15 from air header 17, and the fuel 21 of the combustion media is continuously applied to burners 15 from fuel header 20. Flue gas 23 is continuously recirculated via conduit 40 and headers 16 and 17 from stack 22 to burners 15. Control valve 19 in fuel header 20 regulates the amount of fuel 21 flowing to burners 15. Air 18 incorporating the flue gas 23 is delivered into air header 17 by a forced draft fan 24 from air header 16, and then to burners 15 from air header 17. Application of the diluent flue gas 23 mixed with air 18 in this example provides reduced burning of the combustion gas by burners 15 for producing lowered temperature of flames 15*a* maintained by burners 15 for achieving the various objectives of the invention, namely, favorably influencing $NO_x$ emissions, i.e. reducing $NO_x$ emissions, favorably influencing soot formation by flames 51*a*, i.e. reducing soot formation by flames 15*a*, favorably influencing heat distribution across radiant and convection zones for favorably influencing efficiency, i.e. reducing heat distribution across radiant and convection zones, and favorably influencing uniform thermal elongation of metal tubes that form heating coils 7, 8, and 9, all for favorably influencing metal heating coil life, i.e., reducing heat degradation of the metal heating coils 7, 8, and 9, according to the principle of the invention. Flue gas 23 produces reduced soot formation by flames 15*a*, in accordance with the principle of the invention. Radiation flux directly correlates to flame emissivity. Accordingly, soot formation by flames 15*a* is reduced, which reduces flame emissivity of the flames 15*a*, the ability of the flames 15*a* to emit radiant energy, which, in turn, reduces local radiation flux, all of which contributes to reducing the temperature of the metal heating coils 7, 8, and 9 and reducing heat degradation of the metal heating coils 7, 9, and 9, when the diluent is flue gas 23.

According to the principle of the invention with reference to FIG. 1, a method includes providing furnace 1, furnace 1 includes radiant heating zone 2 having metal heating coils 7,8,9 and burners 15, concurrently applying a combustion media, having a combustibility, and diluent 23 to burners 15, burners 15 burning the combustion media producing flames 15*a* heating radiant heating zone 2, and diluent 23 reducing the combustibility of the combustion media for reducing heat generated by flames 15*a* for reducing heat degradation of the metal heating coils 7,8,9. In this embodiment, the combustion media includes air 18 and fuel 21, and the diluent is flue gas 23. The flue gas 23 is supplied from stack 22 from the operation of furnace 1, and can be applied from another chosen source. Diluent flue gas 23 reduces soot formation inherently generated by flames 15*a*, which reduces flame emissivity of flames 115*a*, which, in turn, reduces local radiation flux, all of which contributes to reducing the temperature of metal heating coils 7, 8, and 9 and reducing heat degradation of metal heating coils 7, 8, and 9. Other diluents can be used in place of flue gas 23, including steam, hydrogen, carbon dioxide, and nitrogen. And so the diluent is selected from a group consisting of flue gas, steam, hydrogen, carbon dioxide, and nitrogen, in an illustrative embodiment. The diluent is supplied from a source of the chosen diluent, whether from furnace 1 or other process equipment or chosen source. In a particular embodiment, the diluent includes two or more diluents, such as two or more diluents selected from the group consisting of flue gas, steam, hydrogen, carbon dioxide, and nitrogen. Like flue gas 23, steam produces reduced soot formation by flames 15*a*, in accordance with the principle of the invention. Accordingly, soot formation by flames 15*a* is reduced, which reduces flame emissivity of the flames 15*a*, the ability of the flames 15*a* to emit radiant energy, which, in turn, reduces local radiation flux, all of which contributes to reducing the temperature of the metal heating coils 7, 8, and 9 and reducing heat degradation of the metal heating coils 7, 9, and 9, when the diluent is steam.

In the embodiment discussed in FIG. 1, the diluent is applied to air 18, which is supplied to burners 15 where it is mixed with fuel 21 to form the combustion media. In an alternate embodiment, the diluent is applied to fuel 21 which is supplied to burners 15 where it is mixed with air 18 to form the combustion media. In this alternate embodiment, conduit 40 couples stack 22 to fuel header 20 in gaseous communication, whereby the diluent, flue gas 23 in this example, is supplied to fuel header 20 where it is mixed with fuel 21 that is applied to burners 15.

According to the principle of the invention, an alternate method includes providing furnace 1, the furnace includes radiant heating zone 2 having metal heating coils 7,8,9 and burners 15, applying the combustion media to the burners, the combustion media has an inherent combustibility and includes, air 18, fuel 21, and a diluent, diluent flue gas 23 in this example, in at least one of air 18 and fuel 21, the burners 15 burning the combustion media producing flames 15*a* heating radiant heating zone 2, and the diluent reducing the combustibility of the combustion media for reducing heat generated by the flames 15*a* for reducing heat degradation of the metal heating coils 7,8,9. In this example, the diluent is flue gas 23. As in the previous embodiment, soot formation by flames 15*a* is reduced, which reduces flame emissivity of the flames 15*a*, the ability of the flames 15*a* to emit radiant energy, which, in turn, reduces local radiation flux, all of which contributes to reducing the temperature of the metal heating coils 7, 8, and 9 and reducing heat degradation of the metal heating coils 7, 9, and 9, when the diluent is flue gas 23. As in the prior embodiment, the diluent can be selected from a group consisting of flue gas, steam, hydrogen, carbon dioxide, and nitrogen, and can be composed of two or more diluents, such as from the group consisting of flue gas, steam, hydrogen, carbon dioxide, and nitrogen. Again, steam produces reduced soot formation by flames 15*a*, in accordance with the principle of the invention. Accordingly, in this alternate embodiment soot formation by flames 15*a* is reduced, which reduces flame emissivity of the flames 15*a*, the ability of the flames 15*a* to emit radiant energy, which, in turn, reduces local radiation flux, all of which contributes to reducing the temperature of the metal heating coils 7, 8, and 9 and reducing heat degradation of the metal heating coils 7, 9, and 9, when the diluent is steam.

Figure 2:
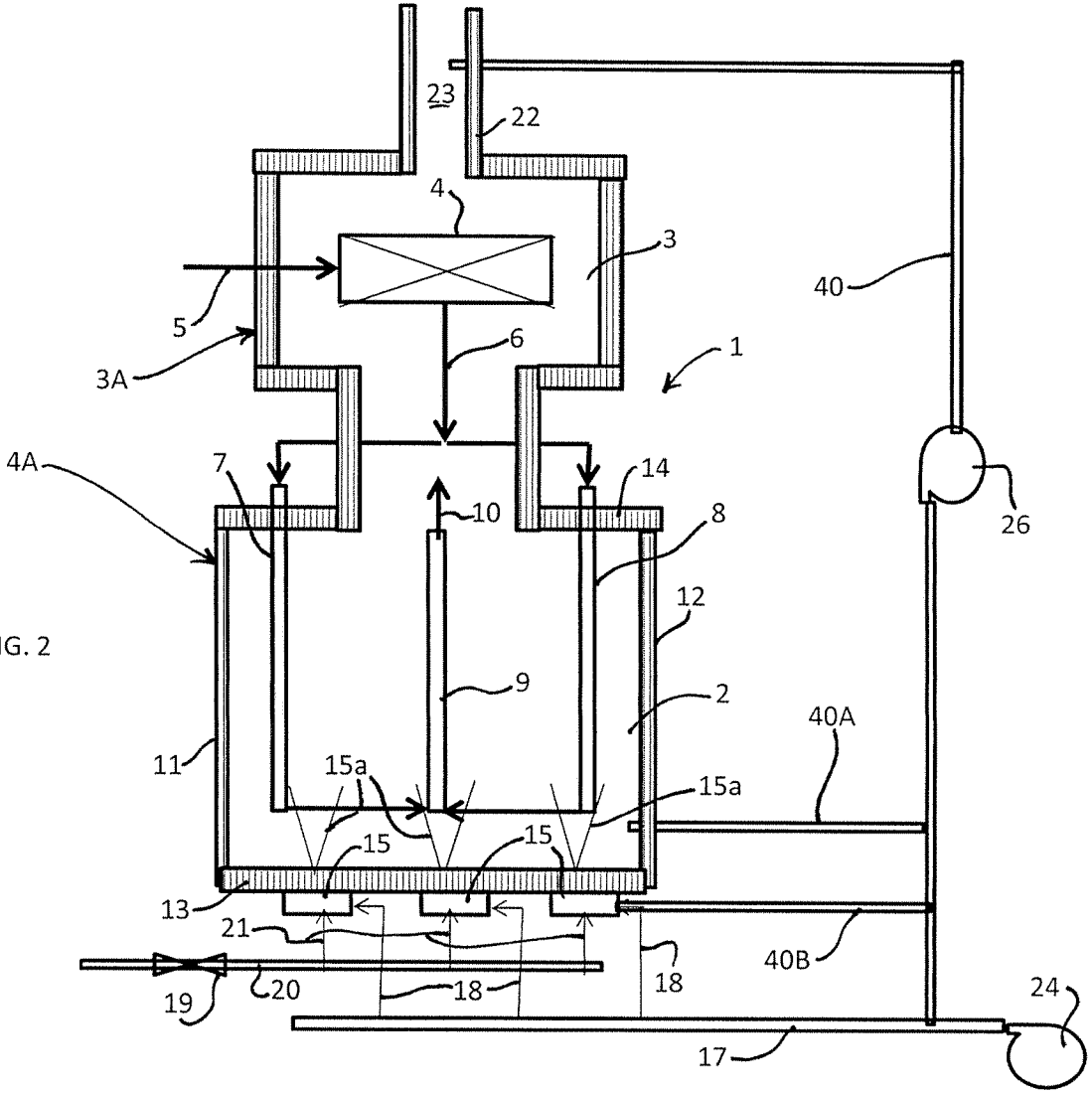

FIG. 2 is a view similar to FIG. 1 illustrating an alternate configuration of furnace 1 for operating in applications where a comparatively higher FGR ratio is achieved as compared to the embodiment of FIG. 1. In this example, conduit 40 couples stack 22 to header 17 in gaseous communication downstream of fan 24, and FGR fan 26 incorporated into conduit 40 forcibly draws the diluent flue gas 23 from stack 22 and forcibly applies it to conduit 40A, conduit 40B, and air header 17 downstream of fan 24. The recirculated flue gas 23 is continuously applied to air header 17 where it is mixed with air 18 downstream of forced draft fan 24. The air 18 mixed with the diluent flue gas 21 is applied to burners 15 from air header 17. Application of the diluent flue gas 23 to air 18 in header 17 in this example provides reduced burning of the combustion media by burners 15 for producing lowered peak temperature of flames 15*a* maintained by burners 15 and reducing soot formation by flames 15*a* as in the embodiment of FIG. 1. In FIG. 2, conduit 40A couples conduit 40 in gaseous communication directly to radiant heating zone 2 of firebox 2A, and conduit 40B couples conduit 40 in gaseous communication to at least one of burners 15. Flue gas 23 is diverted from conduit 40 directly into radiant heating zone 2 via conduit 40A. Flue gas 23 is diverted from conduit 40 directly to at least one burner via conduit 40B. Direct application of flue gas 23 into radiant heating zone 2 from conduit 40 provides reduced burning of the combustion gas by burners 15 for producing lowered peak temperature of flames 15*a* maintained by burners 15 and for reducing soot formation by flames 15*a* for reducing heat degradation of metal heating coils 7, 8, and 9 as in the previous embodiments. The direct application of flue gas 23 to burner 15 mixes with the air 18 and fuel 21, the combustion media, at burner 15 for reducing burning of the combustion gas by the burner 15 for reducing heat degradation of the metal heating coils 7, 8, and 9. The other burners 15 can be similarly coupled to receive flue gas 23 from conduit 40.

Referring to FIG. 2, a method includes providing furnace 1, the furnace includes radiant heating zone 2 having metal heating coils 7,8,9 and burners 15, applying the combustion media to the burners, air 18 from air header 17 and fuel 21 from fuel header 20, the combustion media having a combustibility, burners 15 burning the combustion media producing flames 15*a* heating radiant heating zone 2, applying a diluent, diluent flue gas 23 in this example, to radiant heating zone 2, and the diluent reducing the combustibility of the combustion media by burners 15 for reducing heat generated by flames 15*a* for reducing heat degradation of metal heating coils 7,8,9. As in the prior embodiments, in this embodiment soot formation by flames 15*a* is reduced, which reduces flame emissivity of the flames 15*a*, the ability of the flames 15*a* to emit radiant energy, which, in turn, reduces local radiation flux, all of which contributes to reducing the temperature of the metal heating coils 7, 8, and 9 and reducing heat degradation of the metal heating coils 7, 9, and 9, when the diluent is flue gas 23. As in the prior embodiment, the diluent can be selected from a group consisting of flue gas, steam, hydrogen, carbon dioxide, and nitrogen, from the chosen source, and can be composed of two or more diluents, such as from the group consisting of flue gas, steam, hydrogen, carbon dioxide, and nitrogen. Again, soot formation by flames 15*a* is reduced, which reduces flame emissivity of the flames 15*a*, the ability of the flames 15*a* to emit radiant energy, which, in turn, reduces local radiation flux, all of which contributes to reducing the temperature of the metal heating coils 7, 8, and 9 and reducing heat degradation of the metal heating coils 7, 9, and 9, when the diluent is steam according to an alternate embodiment in accordance with FIG. 2.

Figure 3:
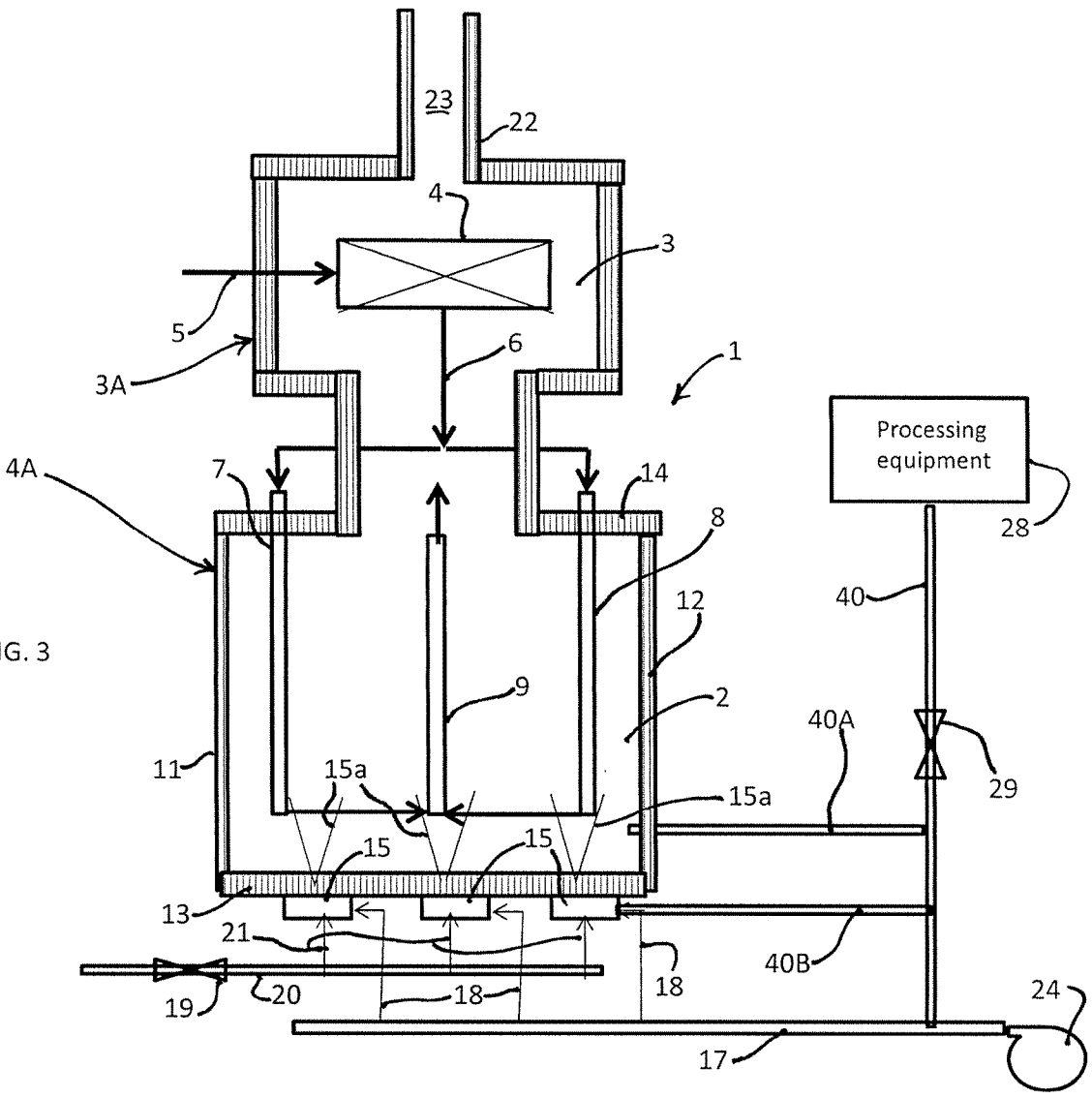

FIG. 3 is a view similar to FIG. 2 illustrating another alternate configuration of furnace 1. In FIG. 3, the source of diluent is not stack 22 of furnace 1 but rather is processing equipment 28. In this embodiment, conduit 40 couples processing equipment 28 to header 17 in gaseous communication downstream of fan 24. Processing equipment 28, a reformer, a $CO_2$ desorption tower, a boiler, or the like, generates a diluent, such as $CO_2$, or steam, which is applied to air header 17 from processing equipment 28 via conduit 40 where it mixes with air 18 downstream of forced draft fan 24. The air 18 mixed with the diluent from processing equipment 28 is continuously applied to burners 15 from air header 17. Application of the diluent from processing equipment 28 to air 18 in header 17 in this example provides reduced burning of the combustion media by burners 15 for producing lowered peak temperature of flames 15*a* maintained by burners 15 as in the embodiment of FIG. 1. In FIG. 3, conduit 40A couples conduit 40 in gaseous communication directly to radiant heating zone 2 of firebox 2A, and conduit 40B couples conduit 40 in gaseous communication to at least one of burners 15. The diluent from processing equipment 28 is diverted from conduit 40 directly into radiant heating zone 2 via conduit 40A. The diluent from processing equipment 28 is diverted from conduit 40 directly to at least one burner via conduit 40B. Direct application of the diluent from processing equipment 28 into radiant heating zone 2 from conduit 40 provides reduced burning of the combustion gas by burners 15 for producing lowered peak temperature of flames 15*a* maintained by burners 15 for reducing heat degradation of metal heating coils 7, 8, and 9. The direct application of the diluent from processing equipment 28 to burner 15 mixes with the air 18 and fuel 21, the combustion media, at burner 15 for reducing burning of the combustion gas by the burner 15 for reducing heat degradation of the metal heating coils 7, 8, and 9. The other burners 15 can be similarly coupled to receive flue gas 23 from conduit 40 in the embodiment of FIG. 3.

Referring to FIG. 3, a method includes providing furnace 1, the furnace includes radiant heating zone 2 having metal heating coils 7,8,9 and burners 15, applying the combustion media to the burners, air 18 from air header 17 and fuel 21 from fuel header 20, the combustion media having a combustibility, burners 15 burning the combustion media producing flames 15*a* heating radiant heating zone 2, applying a diluent, diluent from processing equipment 28 in this example, to radiant heating zone 2, and the diluent reducing the combustibility of the combustion media by burners 15 for reducing heat generated by flames 15*a* for reducing heat degradation of metal heating coils 7,8,9. As in the prior embodiment, the diluent can be selected from a group consisting of flue gas, steam, hydrogen, carbon dioxide, and nitrogen, from the chosen processing equipment, and can be composed of two or more diluents, such as from the group consisting of flue gas, steam, hydrogen, carbon dioxide, and nitrogen. In accordance the FIG. 3, soot formation by flames 15*a* is reduced, which reduces flame emissivity of the flames 15*a*, the ability of the flames 15*a* to emit radiant energy, which, in turn, reduces local radiation flux, all of which contributes to reducing the temperature of the metal heating coils 7, 8, and 9 and reducing heat degradation of the metal heating coils 7, 9, and 9, when the diluent is flue gas 23 in one embodiment, and when the diluent is steam in another embodiment.

Figure 4:
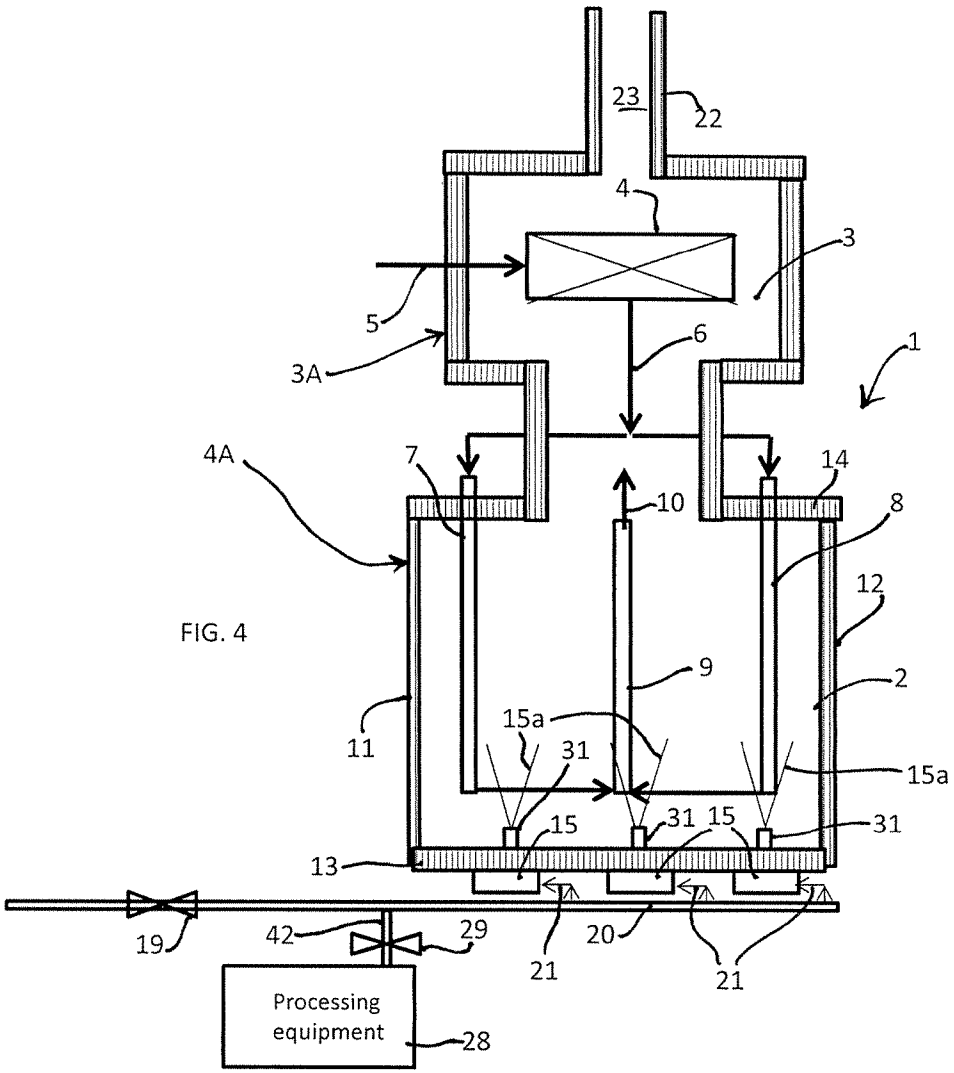

FIG. 4 is a view similar to FIG. 3 illustrating another alternate configuration of furnace 1. In FIG. 4, conduit 42 couples processing equipment 28 in gaseous communication to fuel header 20 downstream of control valve 19. Processing equipment 28 generates the diluent, a diluent process gas product of combustion in this example, such as $CO_2$, steam, or other diluent process gas, which is applied to fuel header 20 from processing equipment 28 via conduit 42. The diluent process gas applied into fuel header 20 between control valve 19 and burners 15 mixes with fuel 21 at header 20 for application to burners 15. The diluent process gas from processing equipment 28 mixed with fuel 21 reduces burning of fuel 21 by burners 15 for reducing heat degradation of the metal heating coils 7, 8, and 9. In this application, existing burner nozzles 31 of burners 15 are enabled to achieve a stable flame with the fuel/diluent mixture from header 20 at various operating loads of furnace operation achieving the objectives of the invention stated above. Pressure control valve 29 in conduit 42 is used to achieve a chosen pressure of the diluent process gas for injection into header 20.

Referring to FIG. 4, a method includes providing furnace 1, the furnace includes radiant heating zone 2 having metal heating coils 7,8,9 and burners 15, applying a combustion media to burners 15, the combustion media has an inherent combustibility and includes, fuel 21 and a diluent, the diluent from processing equipment 28 in this example, applying the combustion media, the fuel 21 and diluent mixture, to the burners 15, and burners 15 burning the combustion media producing flames 15*a* heating radiant heating zone 2, the diluent from processing equipment 28 in fuel 21 reducing the combustibility of the combustion media by burners 15 for reducing heat generated by flames 15*a* for reducing heat degradation of metal heating coils 7,8,9. In accordance the FIG. 3, soot formation by flames 15*a* is reduced, which reduces flame emissivity of the flames 15*a*, the ability of the flames 15*a* to emit radiant energy, which, in turn, reduces local radiation flux, all of which contributes to reducing the temperature of the metal heating coils 7, 8, and 9 and reducing heat degradation of the metal heating coils 7, 9, and 9, when the diluent is flue gas 23 in one embodiment, and when the diluent is steam in another embodiment.

The present invention is described above with reference to illustrative embodiments. However, those skilled in the art will recognize that changes and modifications may be made in the described embodiments without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A method, comprising:

providing a furnace, the furnace includes a radiant heating zone having metal heating coils and burners;

concurrently applying a combustion media and a diluent to the burners, the combustion media having a combustibility;

the burners burning the combustion media producing flames heating the radiant heating zone;

the diluent reducing the combustibility of the combustion media for reducing heat generated by the flames for reducing heat degradation of the metal heating coils providing uniform thermal elongation of the metal coils; and wherein the diluent is selected from at least one from a group consisting of flue gas, steam, hydrogen, carbon dioxide, and nitrogen.

2. The method according to claim 1, wherein the combustion media comprises fuel.

3. The method according to claim 1, wherein the combustion media comprises fuel and air.

4. A method, comprising:

providing a furnace, the furnace includes a radiant heating zone having metal heating coils and burners;

concurrently applying combustion media to the burners, the combustion media has a combustibility and includes, air, fuel, and a diluent;

the burners burning the combustion media producing flames heating the radiant heating zone;

the diluent reducing the combustibility of the combustion media for reducing heat generated by the flames for reducing heat degradation of the metal heating coils providing uniform thermal elongation of the metal coils; and wherein the diluent is selected from at least one from a group consisting of flue gas, steam, hydrogen, carbon dioxide, and nitrogen.

5. The method according to claim 4, wherein the combustion media comprises fuel.

6. The method according to claim 4, wherein the combustion media comprises fuel and air.

7. A method, comprising:

providing a furnace, the furnace includes a radiant heating zone having metal heating coils and burners;

concurrently applying a combustion media to the burners and a diluent to the radiant heating zone, the combustion media having a combustibility;

the burners burning the combustion media producing flames heating the radiant heating zone;

the diluent reducing the combustibility of the combustion media for reducing heat generated by the flames for reducing heat degradation of the metal heating coils providing uniform thermal elongation of the metal coils; and wherein the diluent is selected from at least one from a group consisting of flue gas, steam, hydrogen, carbon dioxide, and nitrogen.

8. The method according to claim 7, wherein the combustion media comprises fuel.

9. The method according to claim 7, wherein the combustion media comprises fuel and air.

* * * * *